US008007237B2

(12) United States Patent
Sreekanth et al.

(10) Patent No.: US 8,007,237 B2
(45) Date of Patent: Aug. 30, 2011

(54) COOLED AIRFOIL COMPONENT

(75) Inventors: Sri Sreekanth, Mississauga (CA); Michael Papple, Ile des Soeurs (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1250 days.

(21) Appl. No.: 11/647,332

(22) Filed: Dec. 29, 2006

(65) Prior Publication Data

US 2008/0156943 A1 Jul. 3, 2008

(51) Int. Cl.
*F01D 5/18* (2006.01)
*F01D 9/06* (2006.01)

(52) U.S. Cl. ..... 416/97 R; 415/115

(58) Field of Classification Search ..... 415/115; 416/96 R, 96 A, 97 R
See application file for complete search history.

(56) References Cited

U.S. PATENT DOCUMENTS

| | | | | |
|---|---|---|---|---|
| 4,118,146 | A * | 10/1978 | Dierberger | 416/97 A |
| 4,762,464 | A | 8/1988 | Vertz et al. | |
| 4,767,260 | A * | 8/1988 | Clevenger et al. | 415/115 |
| 4,808,785 | A | 2/1989 | Vertz et al. | |
| 5,281,084 | A | 1/1994 | Noe et al. | |
| 6,420,677 | B1 | 7/2002 | Emer et al. | |
| 6,781,091 | B2 | 8/2004 | Byrd et al. | |
| 7,019,257 | B2 | 3/2006 | Stevens | |
| 7,041,933 | B2 | 5/2006 | Forrester et al. | |
| 2003/0068222 | A1 * | 4/2003 | Cunha et al. | 415/115 |
| 2005/0058546 | A1 * | 3/2005 | Cooper | 416/97 R |

* cited by examiner

*Primary Examiner* — Christopher Verdier
(74) *Attorney, Agent, or Firm* — Norton Rose OR LLP

(57) ABSTRACT

A gas turbine engine airfoil component having an airfoil body with a core cavity, an end opening in communication with the core cavity, and a wall having a plurality of cooling holes defined therein, each cooling hole being oriented such that the respective hole axis extends out of the core cavity through the end opening.

13 Claims, 5 Drawing Sheets

COOLED AIRFOIL COMPONENT

TECHNICAL FIELD

The invention relates generally to gas turbine engines and, more particularly, to cooled airfoil components for such engines.

BACKGROUND OF THE ART

A commonly used method to cool an airfoil component of a gas turbine engine is to duct cooling air inside the component and then vent this cooling air through a plurality of cooling holes defined through a wall thereof. Such a method is generally used to cool vanes, particularly nozzle guide vanes located at the entry of the turbine section.

The cooling holes defined in the suction side of the nozzle guide vanes are usually oriented in the stream wise direction. As such, due to the curvature of the airfoil of the vane, the cooling holes generally have a substantially large angle with respect to the surface of the vane, and are machined with the tool progressing from the outside of the vane to the inside thereof.

Determining the exact location of each hole before machining is thus based on a substantially complex outer profile of the vane, which becomes even more complex when the vanes are cast as multi-airfoil segments. As such, machining of the cooling holes generally necessitates the determination of multiple reference points on the outer surface of the vane or vane segments, substantially complex manipulation of the vane or vane segments and/or of the machining tool.

In addition, care must be exercised when machining such cooling holes in order to avoid machining too far and damaging the inner surface of the opposed wall of the vane. In particular, when the holes are machined using a laser, a material is generally inserted within the vane to absorb the laser beam when it breaks through the wall being machined to stop the laser from reaching the opposed wall. The insertion of the material within the vane, and its removal after the cooling holes are defined, increases the cost and time of the vane manufacturing process.

In addition, when the vanes are cast as multi-airfoil segments, the location of these holes can generally not be seen and hence are called blind holes or non-line of sight holes. The machining of non-line of sight holes usually requires special electrodes which increases the cost of making these holes.

Accordingly, there is a need to provide an improved cooled airfoil component.

SUMMARY OF THE INVENTION

It is therefore an object of this invention to provide an improved cooled airfoil component for a gas turbine engine.

In one aspect, the present invention provides an airfoil component for a gas turbine engine, the airfoil component comprising an airfoil body defining a leading edge and a trailing edge, the body having opposed walls interconnected at the leading and trailing edges to define a core cavity therebetween, the body also having an end opening defined therein in communication with the core cavity and bordered by the walls, at least one of the walls having a plurality of cooling holes defined therein with a respective hole axis being defined for each of the cooling holes, each cooling hole being oriented such that the respective hole axis extends out of the core cavity through the end opening.

In another aspect, the present invention provides an airfoil assembly for a gas turbine engine, the assembly comprising an annular inner platform, an annular outer platform extending outwardly of and concentric with the inner platform to define an annular gas path therebetween, and a plurality of airfoils extending between the inner and outer platforms, each airfoil having an airfoil body defining a core cavity therein, the body and one of the inner and outer platforms including aligned openings defined therein in communication with the core cavity, the body including a suction side wall having a plurality of cooling holes defined therethrough in communication with the core cavity, each cooling hole defining a respective hole axis oriented such as to extend across the core cavity and through the aligned openings without intersecting the airfoil body.

In a further aspect, the present invention provides a method of manufacturing a cooled airfoil component for a gas turbine engine, the method including forming an airfoil body defining a core cavity therein and an end opening in communication with the core cavity, passing a tool through the end opening and across the core cavity to machine an inner surface of a wall of the airfoil body, and forming at least one cooling hole through the wall from the inner surface thereof along a longitudinal axis of the tool.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
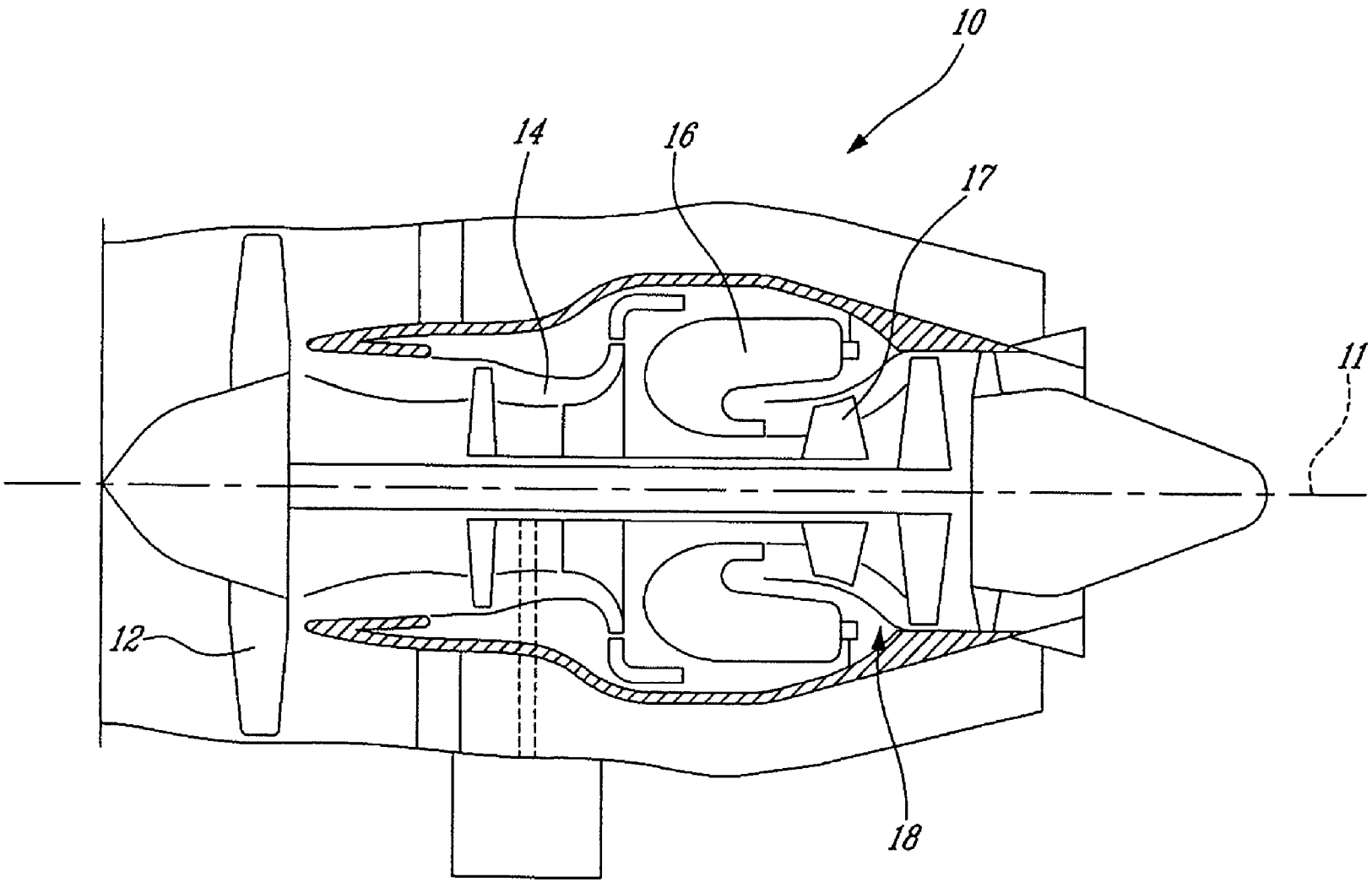
FIG. 1 is a schematic cross-section of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

The turbine section 18 further comprises at least a high pressure turbine stage 17 which is immediately downstream from the combustor 16. The high pressure turbine (HPT) stage 17 includes a turbine rotor (not shown) with a plurality of radially extending turbine blades, and a HPT vane assembly or nozzle guide vane assembly 22 (see FIG. 2) immediately upstream therefrom. The HPT vane assembly 22 is therefore immediately downstream from the exit of the combustor 16 of the gas turbine engine 10.

Figure 2:
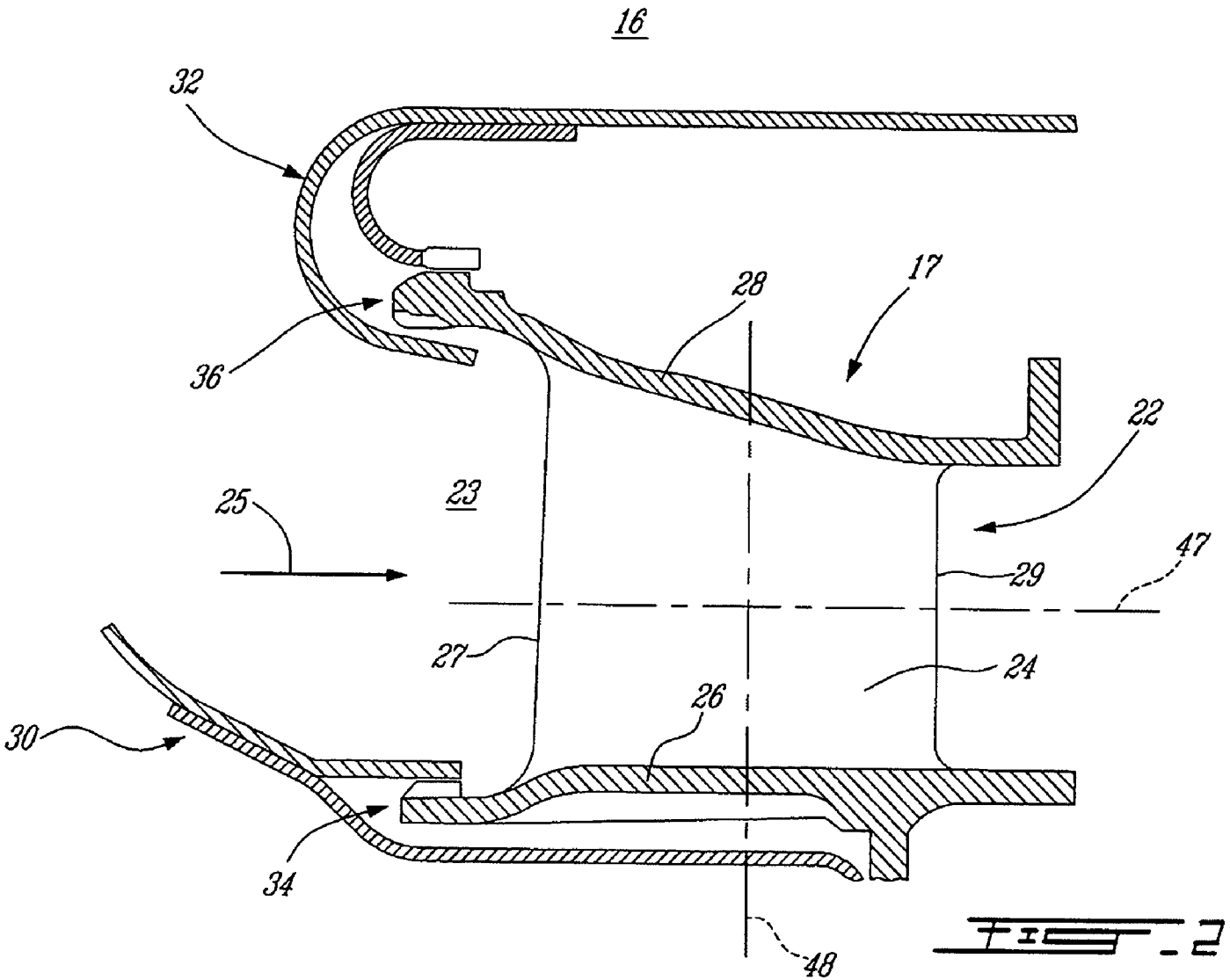
FIG. 2 is a cross-section of a high pressure turbine vane assembly, which can be used in a gas turbine engine such as shown in FIG. 1.

Referring to FIG. 2, the HPT vane assembly 22 comprises a plurality of airfoils 24 radially extending between an annular inner platform 26 and an annular outer platform 28. The platforms 26, 28 are circumferentially disposed about a central axis 11 (see FIG. 1) of the gas turbine engine 10 to define an annular gas path passage 23 therebetween, within which the hot combustion gases are channeled generally in direction 25. Each airfoil or airfoil body 24 defines a leading edge 27 and an opposed trailing edge 29, the combustion gases circulating around the airfoil body 24 from the leading edge 27 to the trailing edge 29.

The HPT vane assembly 22 is located immediately downstream from the combustor 16, and is accordingly engaged thereto at the combustor exit. Generally, the vane inner platform 26 of the HPT vane assembly 22 is engaged to a radially inner wall 30 of the combustor 16 by an inner joint assembly 34, and the vane outer platform 28 is engaged to a radially outer wall 32 of the combustor 16 by an outer joint assembly 36.

Figure 3:
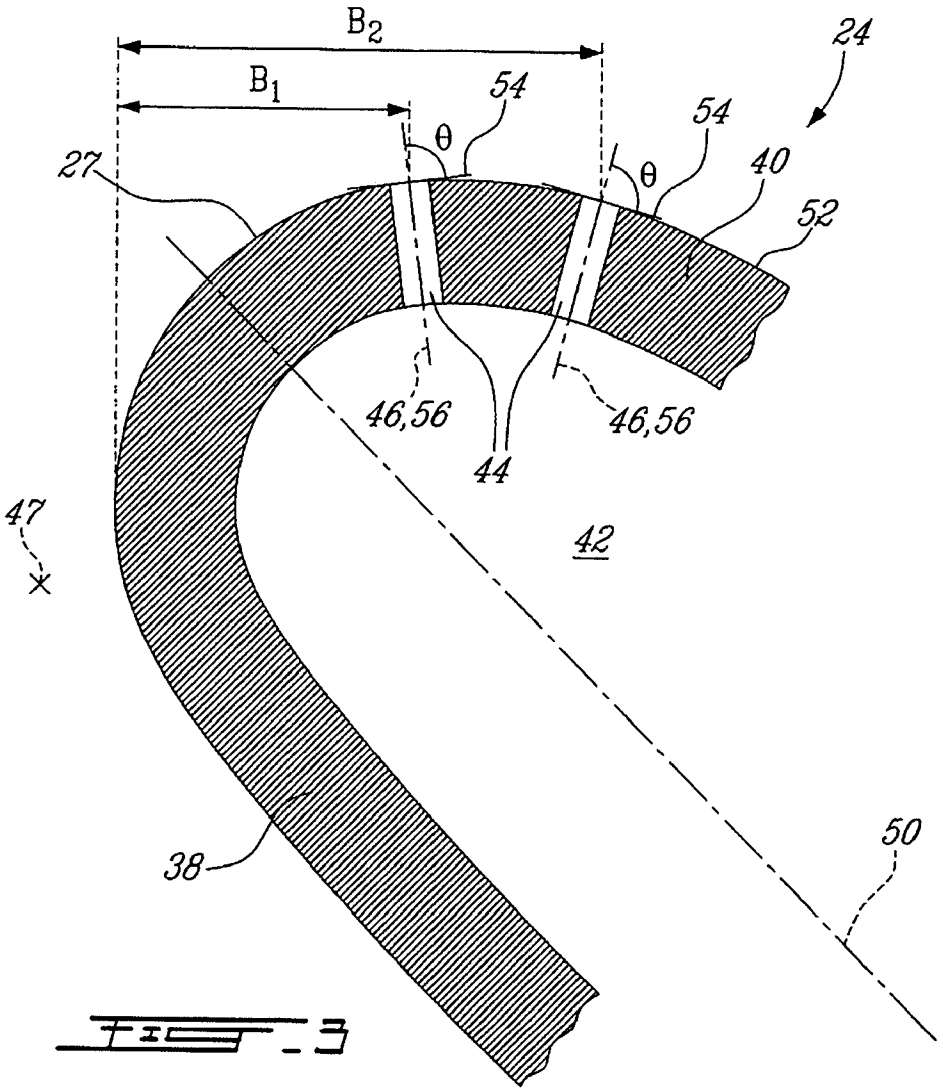
FIG. 3 is a cross-section of a portion of an airfoil of the vane assembly of FIG. 2, taken along a circumferential plane of the vane assembly.

Referring to FIG. 3, each airfoil body 24 includes a pressure side wall 38 and a suction side wall 40 which are interconnected at the leading edge 27 and at the trailing edge 29 (not visible in FIG. 3). The interconnected walls 38, 40 define a core cavity 42 therebetween through which air can circulate. Although not shown, internal walls can extend across the core cavity 42 to define separate sections thereof.

Figure 4:
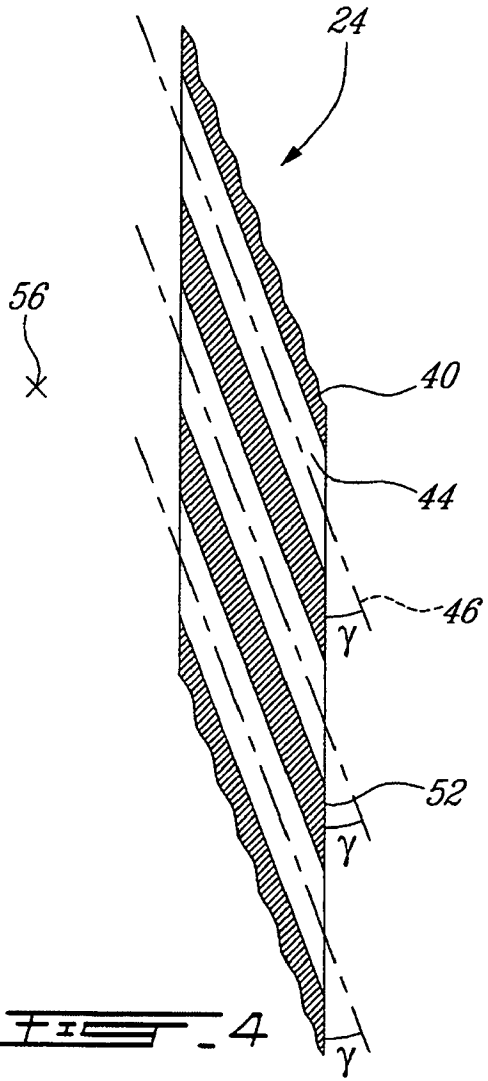
FIG. 4 is a cross-section of a portion of the airfoil of FIG. 3, taken along a radial plane of the vane assembly passing through the axis of any one of the cooling holes defined in the airfoil.
Figure 7:
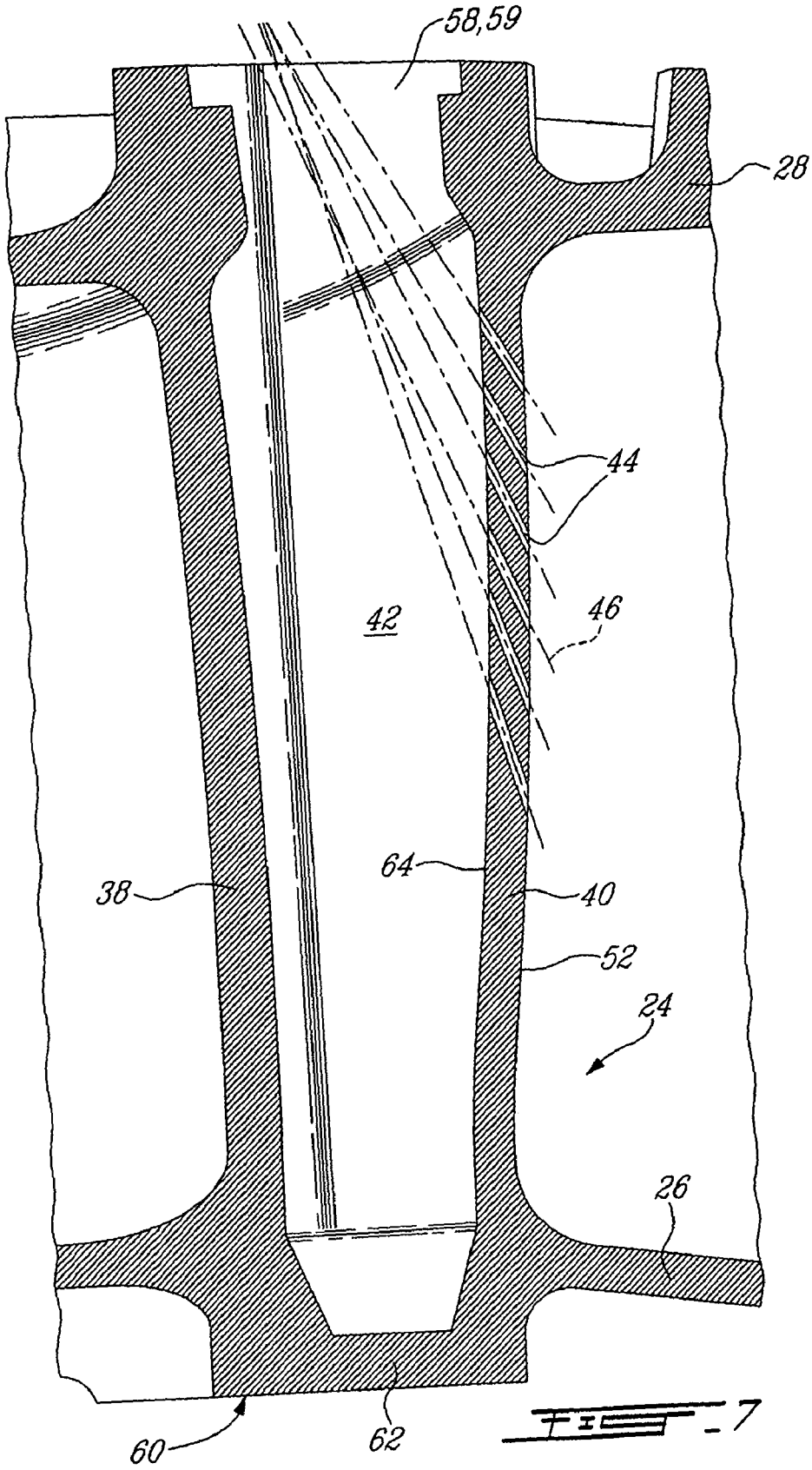
FIG. 7 is a perspective, cross-sectional view of a portion of the vane assembly of FIG. 1 with the airfoil of FIGS. 3-4, taken along a radial plane similar to that of FIG. 3.

Referring to FIGS. 3, 4 and 7, the suction side wall 40 includes a plurality of cooling holes 44 defined therethrough. Each cooling hole 44 is cylindrical and defines a hole axis 46 which corresponds to a central axis thereof. In the embodiment shown, the cooling holes 44 are defined through the suction side wall 40 in a region defined between a minimum portion B1 of the axial chord and a maximal portion B2 of the axial chord (see FIG. 3). In a particular embodiment, B1 represents 10% of the axial chord and B2 represents 35% of the axial chord. Although in the embodiment shown only two columns of aligned cooling holes are depicted, i.e. one at B1 and one at B2, it is understood that a number of unaligned cooling holes and/or columns of aligned cooling holes can be defined between B1 and B2 as well.

Referring to FIG. 3, a portion of the airfoil body 24 is shown taken in cross-section along a circumferential plane 47 (see FIG. 2) defined along a circumferential direction of the inner and outer platforms 26, 28. In other words, the circumferential plane 47 is the plane of the sheet in FIG. 3. The circumferential plane 47 can also be defined as a transverse plane extending perpendicularly to a longitudinal axis 48 of the airfoil (see FIG. 2) which, in turn, is located at mid-distance between the leading and trailing edges 27, 29 and within a longitudinal plane 50 extending therebetween. In FIG. 3 it can be seen that the projection of each hole axis 46 on the transverse or circumferential plane 47 forms an angle θ with the intersection of the transverse or circumferential plane 47 with the outer surface 52 of the suction side wall 40. Such an angle can be measured between the projection of the hole axis 46 and a tangent 54 to the outer surface 52 adjacent the cooling hole 44. In a particular embodiment, the angle θ is at least 55 degrees and at most 90 degrees. In the embodiment shown, the angle θ is 90 degrees or approximately 90 degrees, thus defining cooling holes 44 extending normally to the outer surface 52 when viewed in the transverse or circumferential plane 47.

Referring to FIG. 4, a portion of the airfoil body 24 is shown taken in cross-section along a radial plane 56 (see FIG. 3) defined along a radial direction of the inner and outer platforms 26, 28 and containing any one of the hole axes 46, such that a radial plane 56 is defined for each column of aligned cooling holes 44. In other words, the radial plane 56 is the plane of the sheet in FIG. 4. The radial plane 56 can also be defined as a hole plane extending parallel to the longitudinal axis 48 of the airfoil (see FIG. 2) and containing the corresponding hole axis 46. In FIG. 4 it can be seen that each hole axis 46 forms an angle γ with the intersection of the radial or hole plane 56 with the outer surface 52 of the suction side wall 40. In a particular embodiment, the angle γ is at least 10 degrees and at most 35 degrees.

Referring particularly to FIG. 7, the airfoil body 24 further includes at least one end opening 58 which is in communication with the core cavity 42 and bordered by the pressure and suction side walls 38, 40. In the embodiment shown, the end opening 58 is defined in an outer portion of the airfoil body 24, i.e. a portion of the airfoil body 24 received in the outer platform 28, and the outer platform 28 also includes an opening 59 defined therein aligned with the opening 58. The airfoil body 24 includes a closed end 60 opposite of the end opening 58, i.e. the pressure and suction side walls 38, 40 are interconnected through an inner wall 62 which defines part of the inner platform 26. It can be seen that the combination of the angles θ, γ described above is selected for each hole axis 46 such that the hole axis 46 is oriented to extend across the core cavity 42 and through the end opening 58. As such, each hole axis 46 extends from the respective cooling hole 44 to the end opening 58 without intersecting the airfoil body 24. The cooling holes 44 can thus advantageously be machined from the inside of the core cavity 42, i.e. by passing a machining tool through the end opening 58 to reach an inner surface 64 of the suction side wall 40 and form the cooling hole 44 from the inner surface 64 to the outer surface 52 of the wall 40.

Accordingly, in a particular embodiment, the vane is manufactured according to the following. The airfoil body 24 is formed including the core cavity 42 and the end opening 58 defined therein, for example through a casting operation. The airfoil body 24 can optionally be formed together with and interconnected to one or more identical airfoil bodies such as to define a multi-airfoil segment. A tool is passed through the end opening 58 and across the core cavity 42 to machine the inner surface 64 of the wall in which the cooling holes 44 are to be defined, which in the embodiment shown is the suction side wall 40. The tool then defines one cooling hole 44 through the wall 40 along a longitudinal axis of the tool (corresponding to the respective hole axis 46). The process is repeated until all the cooling holes 44 are machined.

In a particular embodiment, the tool is an electro discharge (EDM) drill. Alternate tools include, for example, laser drills.

Figure 6:
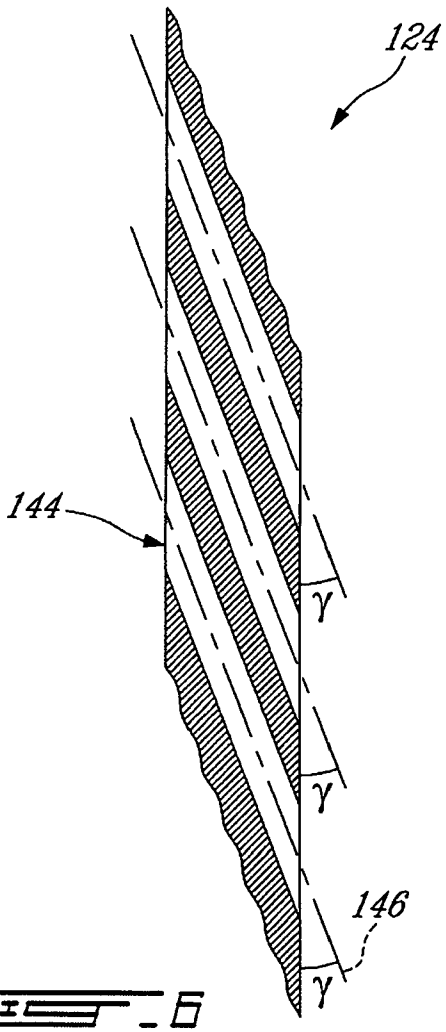
FIG. 6 is a cross-section of a portion of the airfoil of FIG. 5, taken along a radial plane of the vane assembly passing through the axis of any one of the cooling holes defined in the airfoil.
Figure 5:
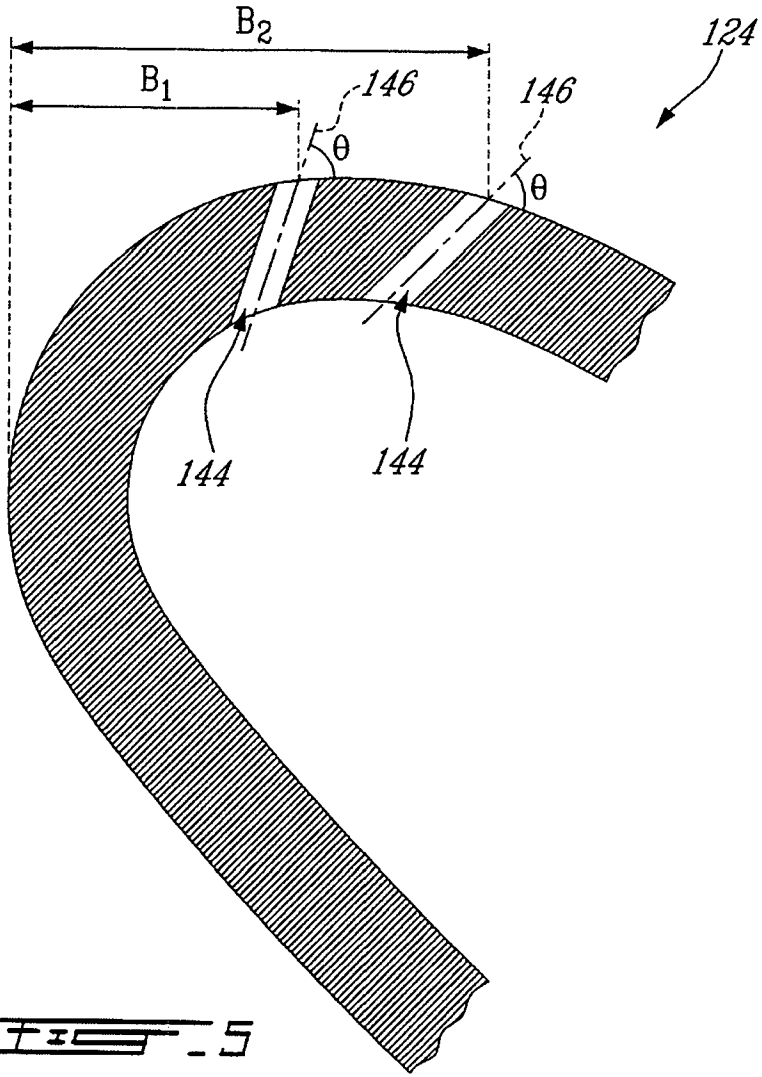
FIG. 5 is a cross-section of a portion of an alternate airfoil of the vane assembly of FIG. 2, taken along a circumferential plane of the vane assembly.

Referring to FIGS. 5-6, an alternate airfoil configuration is shown. The alternate airfoil body 124 is similar to the airfoil body 24 described above, with the exception that the angle of each cooling hole 144 is between 60 and 65 degrees. Similarly to the airfoil body 24 described above, the combination of the angles θ, γ is selected for each hole axis 146 such that the hole axis 146 is oriented to extend across the core cavity 42 and through the end opening 58 (see FIG. 7 of the previous embodiment).

The orientation of the cooling holes 44, 144 allows the machining thereof from inside the core cavity 42, by passing through the end opening 58. The inventors have found that even with a radial orientation of the cooling holes 44, 144 (0=near or at 90 degrees), the aerodynamic penalty is minimal or absent with respect to usual cooling holes oriented in the stream wise direction. However, as the cooling holes 44, 144 can be manufactured from inside the core cavity 42, the machining process is simplified. As the position of the cooling holes 44, 144 is computed for machining with respect to the inner profile of each airfoil body 24, 124, the cooling holes 44, 144 can be manufactured regardless of the outer profile of the airfoil body 24, 124 which can be relatively complex, especially in the case of multi-airfoil segments. As such, the manufacturing time and costs are minimized.

The above description is meant to be exemplary only, and one skilled in the art will recognize that changes may be made to the embodiments described without department from the scope of the invention disclosed. For example, although the present invention has been described with respect to the nozzle guide vane assembly 22, the present invention could be applied to any other adequate airfoil components of a gas turbine engine, such as for example other types of vane assemblies. Still other modifications which fall within the scope of the present invention will be apparent to those skilled in the art, in light of a review of this disclosure, and such modifications are intended to fall within the appended claims.

What is claimed is:

1. An airfoil component for a gas turbine engine, the airfoil component comprising an airfoil body defining a leading edge and a trailing edge, the body having opposed first and second walls interconnected at the leading and trailing edges to define a core cavity therebetween, the body also having an end opening defined therein in communication with the core cavity and bordered by the walls, at least the first wall having a plurality of radially extending rows of non parallel cooling holes defined therein with a respective hole axis being defined for each of the cooling holes, the cooling holes of the first wall being oriented such that all of the hole axes extend within the core cavity and through the end opening without intersecting the second wall.

2. The airfoil component as defined in claim 1, wherein the respective hole axis corresponds to a central axis of the entire hole.

3. The airfoil component as defined in claim 1, wherein the first wall defines a suction side of the airfoil body.

4. The airfoil component as defined in claim 1, wherein the cooling holes are defined between 10% and 35% of an axial chord of the airfoil body.

5. The airfoil component as defined in claim 1, wherein the airfoil body defines a longitudinal plane extending from the leading edge to the trailing edge, a longitudinal axis extending within the longitudinal plane at equal distance from the leading edge and the trailing edge, and a transverse plane extending perpendicularly to the longitudinal axis, a projection of each hole axis on the transverse plane forming an angle of at least 55 degrees and at most 90 degrees with an intersection of the transverse plane and an outer surface of the first wall.

6. The airfoil component as defined in claim 1, wherein the airfoil body defines a longitudinal plane extending from the leading edge to the trailing edge, a longitudinal axis extending within the longitudinal plane at equal distance from the leading edge and the trailing edge, and a hole plane for each hole extending parallel to the longitudinal axis and containing the respective hole axis, the hole axis forming an angle of at least 10 degrees and at most 35 degrees with an intersection of the hole plane and an outer surface of the first wall.

7. The airfoil component as defined in claim 6, wherein the airfoil body defines a transverse plane extending perpendicularly to the longitudinal axis, a projection of each hole axis on the transverse plane forming an angle of at least 55 degrees and at most 90 degrees with an intersection of the transverse plane and an outer surface of the first wall.

8. An airfoil assembly for a gas turbine engine, the assembly comprising:

an annular inner platform;

an annular outer platform extending outwardly of and concentric with the inner platform to define an annular gas path therebetween; and a plurality of airfoils extending between the inner and outer platforms, each airfoil having an airfoil body defining a core cavity therein, the body and one of the inner and outer platforms including aligned openings defined therein in communication with the core cavity, the body including a suction side wall having a plurality of rows of non parallel cooling holes defined therethrough in communication with the core cavity with the rows being defined along a direction extending between the inner and outer platforms, all of the cooling holes of said plurality of rows each defining a respective hole axis oriented such as to extend across the core cavity and through the aligned openings without intersecting the airfoil body.

9. The airfoil assembly as defined in claim 8, wherein the body and the outer platform include the aligned openings defined therein.

10. The airfoil assembly as defined in claim 8, wherein the cooling holes are defined in the suction side wall between 10% and 35% of an axial chord of the airfoil.

11. The airfoil assembly as defined in claim 8, wherein a projection of each hole axis on a corresponding circumferential plane extending circumferentially with respect to the inner and outer platforms forms an angle of at least 55 degrees and at most 90 degrees with an intersection of the circumferential plane and an outer surface of the suction side wall.

12. The airfoil assembly as defined in claim 8, wherein a radial plane is defined for each hole extending radially with respect to the inner and outer platforms and containing the respective hole axis, the hole axis forming an angle of at least 10 degrees and at most 35 degrees with an intersection of the radial plane and an outer surface of the suction side wall.

13. The airfoil assembly as defined in claim 12, wherein a projection of each hole axis on a corresponding circumferential plane extending circumferentially with respect to the inner and outer platforms forms an angle of at least 55 degrees and at most 90 degrees with an intersection of the circumferential plane and the outer surface of the suction side wall.

* * * * *